United States Patent [19]

Kiwior et al.

[11] Patent Number: 4,497,347

[45] Date of Patent: Feb. 5, 1985

[54] MECHANISM FOR ACTUATING THE WEFT-INSERTING NEEDLES OF A WEAVING LOOM

[75] Inventors: Denis Kiwior, Riedisheim; Victor Riner, Mulhouse, both of France

[73] Assignee: Societe Alsacienne de Construction de Materiel Textile, France

[21] Appl. No.: 439,639

[22] Filed: Nov. 5, 1982

[30] Foreign Application Priority Data

Dec. 11, 1981 [FR] France ..... 81 23169

[51] Int. Cl.[3] ..... D03D 47/00

[52] U.S. Cl. ..... 139/449

[58] Field of Search ..... 139/444–449

[56] References Cited

U.S. PATENT DOCUMENTS

| | | | |
|---|---|---|---|
| 2,688,344 | 9/1954 | Dewas | 139/449 |
| 3,159,186 | 12/1964 | Juillard | 139/446 |
| 3,312,252 | 4/1967 | Dewas | 139/448 |
| 3,487,859 | 1/1970 | Piccoli | 139/446 |
| 3,580,291 | 5/1971 | Piccoli | 139/448 |
| 4,040,453 | 8/1977 | Juillard et al. | 139/446 |
| 4,102,363 | 7/1978 | Deborde | 139/449 |

FOREIGN PATENT DOCUMENTS

| | | | |
|---|---|---|---|
| 1148263 | 4/1969 | United Kingdom | 139/449 |
| 1236544 | 6/1971 | United Kingdom | 139/449 |

*Primary Examiner*—James Kee Chi

*Attorney, Agent, or Firm*—Cantor and Lessler

[57] ABSTRACT

In a device for driving the weft-inserting needles of a shuttleless loom in a rectilinear reciprocating movement, each needle is connected to the needle-actuating system by means of a flexible connecting member or so-called flector and is guided within a rail by means of a block of antifriction material attached to the end of the needle. By means of the device, vibrations of the driving mechanism are not transmitted to the weft-inserting needle at high operating speeds of the loom.

9 Claims, 11 Drawing Figures

FIG. 7
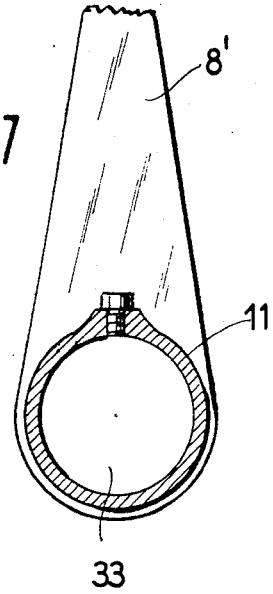
FIG. 8
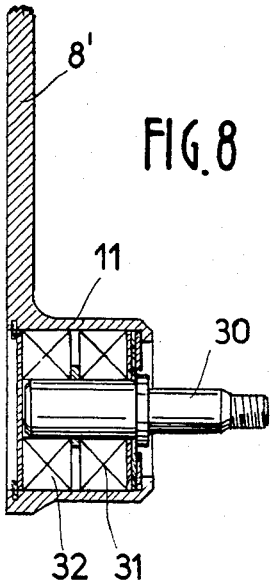
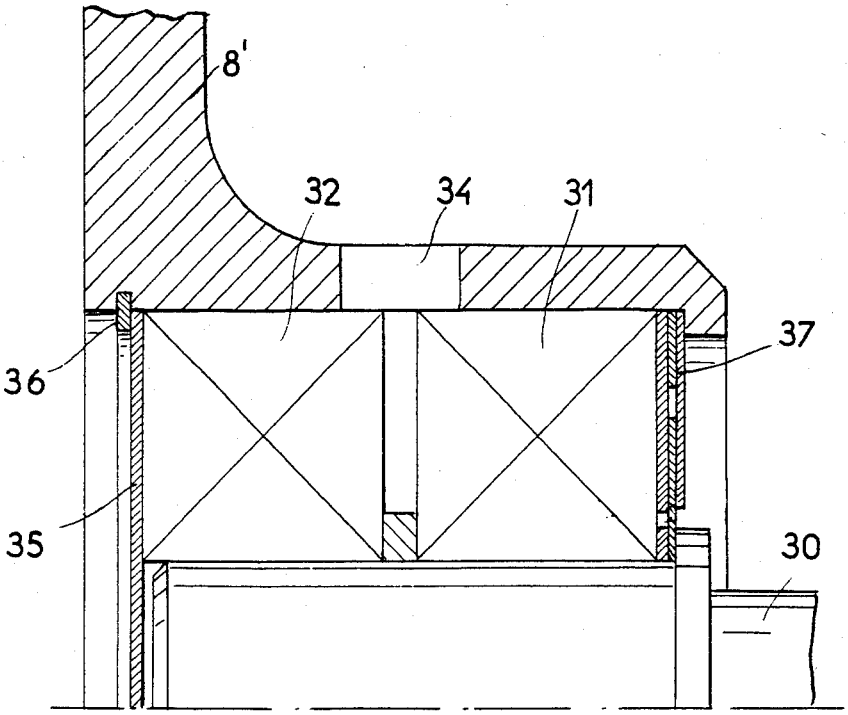
FIG. 9

MECHANISM FOR ACTUATING THE WEFT-INSERTING NEEDLES OF A WEAVING LOOM

This invention relates to the textile industry and more particularly to weaving looms which make use of weft-inserting needles.

Insertion of the weft in the shed of some types of shuttleless looms is performed by means of two needles driven in rectilinear reciprocating motion in opposite directions. The so-called entrance needle grips the weft thread which is stored in a suitable location, inserts the thread in the shed and, at a point corresponding to the center of the cloth, transfers the thread to the so-called exit needle which draws the thread to the selvedge of the cloth.

As a general rule, the needles are rigidly fixed to the part which drives them in reciprocating motion in synchronism with the movement of the reed-carrying slay. The fact that the needles have a constant trajectory is due to the rigidity of this attachment.

However, when it is desired to increase the beating-up rate of the loom in order to increase the production speed, it becomes necessary to maintain a very high degree of accuracy in the trajectory of the needles in order to ensure that the two needles meet in a reliable manner for the purpose of exchanging the weft thread at the center of the cloth and in order to ensure that the needles are not liable to come into contact with the warp threads at high operating speeds. The least imperfection in the movement of the part which drives the needles has an undesirable effect on the needle trajectory and may result in warp thread breakages or failures in weft thread exchanges.

In order to overcome this drawback, one solution consists in replacing the rigid connection between needle and needle-drive system by a connection which provides a certain number of degrees of freedom, thereby entailing the need for guiding of the needle in order to define its trajectory with precision.

One known form of construction which can be mentioned by way of example is described in U.S. Pat. No. 4,040,453 which is commonly assigned herewith. In this design, the connection between needle and drive system is provided by a link-arm, one end of which is attached to the drive unit whilst the other end has the effect of a knuckle-joint which is capable of displacement within a housing carried by the needle. The needle also carries a part which is fitted with two antifriction shoes and these latter are adapted to cooperate with a rail which serves to guide the needle.

The major drawback of this device lies in the fact that it is subject to rapid wear. Contacts between a knuckle-joint and its housing are always restricted to one point, with the result that the knuckle-joint wears very rapidly irrespective of the nature of the contacting surfaces. The same applies to the attached guide shoes whch are in rubbing contact with the rail.

In order to provide a more reliable device, the invention described hereinafter proposes to replace the knuckle-joint link-arm by a flexible motion-transmission member or so-called "flector" and to provide a massive block which constitutes the needle-guiding member and is slidably mounted within the rail. The invention therefore relates to a device for driving the weft-inserting needles of a loom in rectilinear reciprocating motion. The distinctive feature of this device lies in the fact that the needle is connected to the needle-actuating system by means of a flector and is guided within a rail by means of a block of antifriction material which is rigidly fixed to the needle.

By virtue of this flexible connection between the needle and its actuating member, vibrations and other parasitic movements which inevitably appear in the actuating member at high operating speeds of the loom are no longer transmitted to the needle, thereby endowing the movement of travel of the needle with enhanced accuracy.

Other features of the invention will be more apparent upon consideration of the following description and accompanying drawings, wherein:

FIG. 7 is a schematic view of the member which provides a connection between the needle and its drive system;

FIG. 8 is a profile view of FIG. 7;

FIG. 9 is an enlarged view of a portion of FIG. 7;

Figure 1:
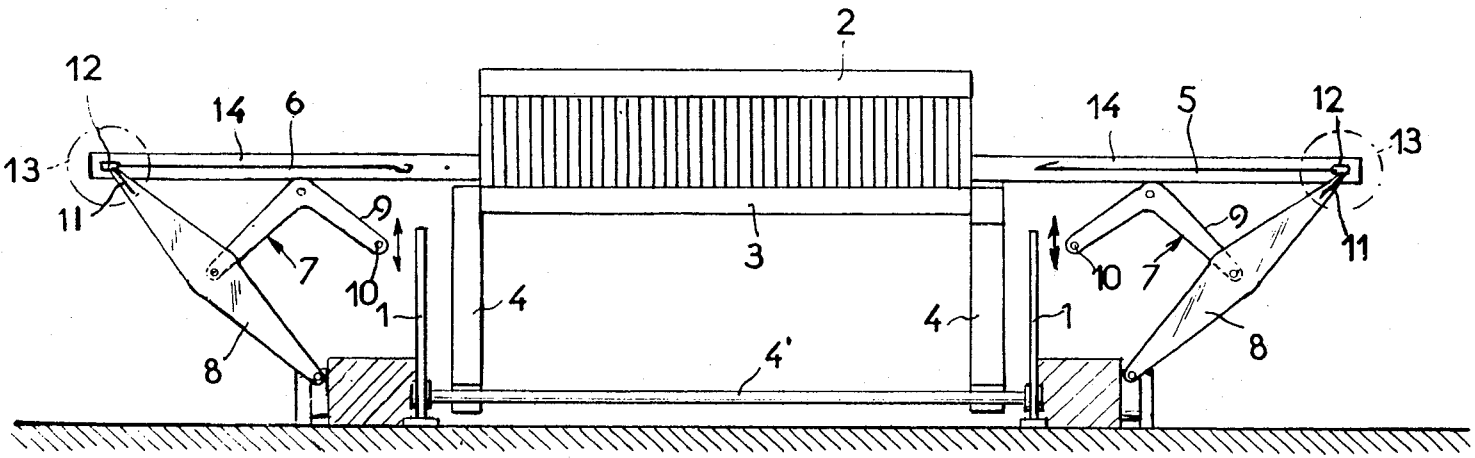
FIG. 1 is a simplified view of a weaving loom of the shuttleless type to which the invention is applicable.

The shuttleless loom as illustrated schematically in FIG. 1 comprises a frame 1, a reed 2 mounted on the slay 3, the swords 4 of which are pivotally mounted on a shaft 4'. The weft-inserting entrance needle 5 and the weft-inserting exit needle 6 are each driven by an actuating mechanism which is designated by the general reference numeral 7.

This actuating mechanism can be of any known type for weaving looms. FIG. 1 therefore shows only one example of a conventional actuating mechanism comprising an oscillating lever 8 (or so-called lozenge) actuated by an elbowed lever 9, the end 10 of which is driven by any conventional system (not shown) such as a cam-type mechanism, for example.

The end 11 of the lever 8 carries out a rectilinear reciprocating movement. One coupling means of known type between said end 11 of the lever and the end 12 of the corresponding needle (5 or 6) consisted of a knuckle-joint which was carried by the end of the lever and engaged within a corresponding housing provided on the end of the needle, this assembly being represented in FIG. 1 by a chain-dotted circle 13. The precise object of the present invention is to improve this coupling system.

Figure 2:
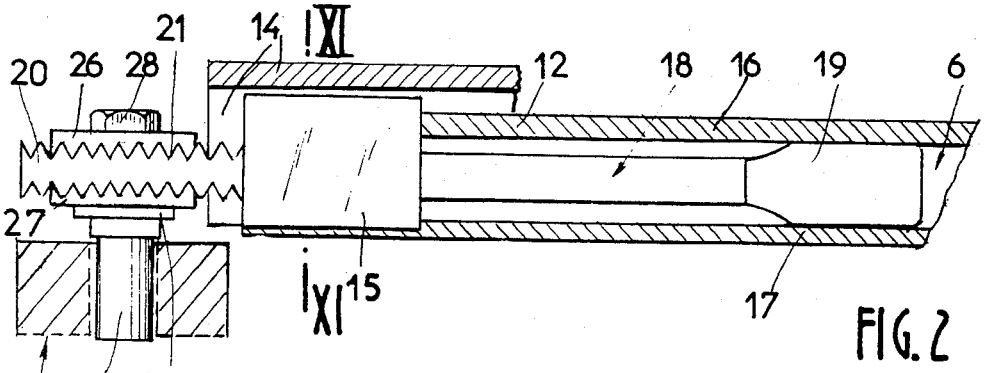
FIG. 2 is a general schematic plan view of the device according to the invention, in which certain portions have been cut away.

There is shown in FIG. 2 the end portion 12 of the weft-inserting needle 6 (or 5) which is actuated by the end 11 of a lever 8', the needle being displaced in a rectilinear reciprocating movement through the shed. In that portion of the needle trajectory which is located outside the shed, the needle is guided by a rail 14 in which is slidably mounted a shoe 15, said shoe being rigidly fixed to the end portion 12 of the needle.

Figure 10:
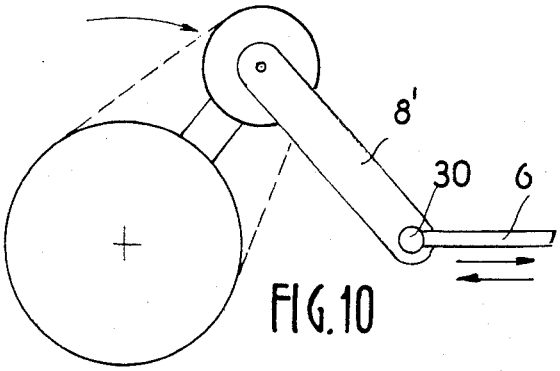
FIG. 10 is a schematic representation of another known actuating mechanism for weft-inserting needles of weaving looms.

FIGS. 7, 8 and 9 are views in greater detail showing the end of the needle-actuating lever which can be constituted either by an oscillating lever (lever 8 in FIG. 1) or by a rotary arm 8', the center of rotation of which in turn describes a circle about a fixed axis in order that the end of the rotary arm should carry out a rectilinear reciprocating movement according to the principle known as Cardan's circle which is recalled schematically in FIG. 10.

Figure 11:
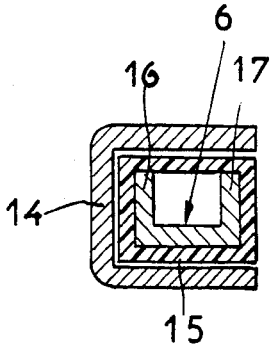
FIG. 11 is a vertical sectional view taken along line XI—XI of FIG. 2.

The needle 5 or 6 can consist of a tubular rod; but in one embodiment of the invention, the needle has a U-shaped profile, the arms 16 and 17 of which are bent-back in the upward direction (as shown in FIGS. 2 and 11). The end portion 12 of each needle is forcibly fitted in a block 15 having a base of plastic material and a low coefficient of friction, such as "Celoron" which is a laminated product of fibers and canvas cemented together by means of a resin. Said block of Celoron constitutes the guide shoe of the needle which slides within the rail 14.

The rail 14 completely surrounds the block 15 on three sides. On the fourth side, said rail has an opening for the passage of the connecting pin between the needle and its drive system. A flexible motion-transmission member or flector 18 is secured by bonding, for example, to the bottom of the U-shaped sectional member constituting the needle 6 and on the same side as the needle-actuating member.

The bonded portion is limited to the end 19 which is remote from the actuating member 8'. The other end 20 of the flector has two opposite surfaces provided with teeth 21 and is pierced by an elongated slot 22. In order to increase its fatigue strength, the flector 18 can be formed of graphite-loaded polyamide known as "Nylatron".

Figure 3:
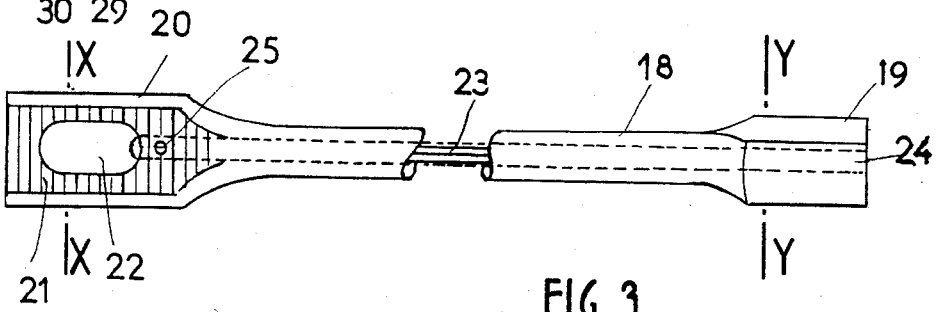
FIG. 3 is a part-sectional view in elevation showing one embodiment of the flector which forms part of the invention.
Figure 4:
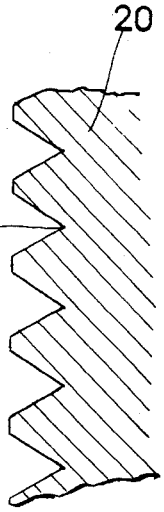
FIG. 4 illustrates the teeth which are machined on a portion of the flector.
Figure 5:
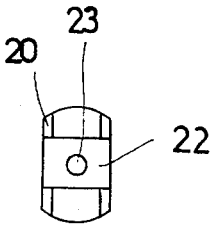
FIGS. 5 and 6 are sectional views of the flector taken respectively along lines X—X and Y—Y, respectively of FIG. 3.
Figure 6:
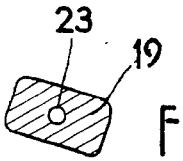

The strength of the flector can also be increased by means of a cord reinforcement 23 made, for example, of aramid fiber of the type marketed under the trade name of "Kevlar". As shown in FIGS. 3, 5 and 6, the cord passes within an axial passageway 24 of the flector and around a dowel-pin 25. The two strands are attached to the end portion 19 of the flector by bonding with adhesive.

The flector 18 can also be made of a suitable grade of steel, in which case there is no need for any reinforcement.

Two plates 26, 27 of metal, for example, are so arranged as to clamp the end portion 20 of the flector 18. To this end, one face of each plate is provided with teeth which are identical with the teeth 21 formed on said end portion 20 of the flector, the teeth of the two opposite surfaces being intended to interengage as shown in FIG. 2. The plates 26, 27 are maintained in position by a screw 28 and a washer 29. The screw 28 also serves to secure a spindle 30 which is driven in a rectilinear reciprocating movement by the end of the needle-actuating arm 8 or 8'. By virtue of the elongated slot 22, the plates 26, 27 can be displaced by a certain number of teeth with respect to the flector 18. This makes it possible to adjust the length of the needle 6 in a simple and accurate manner. In fact, since the pitch of the teeth is known, it is therefore only necessary to displace the plates 26, 27 by a given number of teeth in order to vary the position of the needle 6 to a predetermined extent. This method of adjustment constitutes a substantial improvement over the method which consists in displacing the entire movement of the needle.

As shown in FIG. 8, the spindle 30 is adapted to cooperate with ball-bearings 31–32 mounted within the bore 33 of the actuating member 8'. These two ball-bearings 31–32 can be replaced by a single bearing. A lubricator 34 is continuously fed from a lubricant reservoir (not shown) which is attached to the member 8'. In order to ensure enhanced fluid-tightness of the bearings, the housing 33 is closed at one end by a plate 35 which is secured by a circlip 36 and at the other end by a series of very thin sheet-metal plates 37 arranged in the form of baffle-plates.

These precautions are essential in the case of looms which have a high beating-up speed and particularly when the needle-actuating lever 8' is a rotating arm as shown in FIG. 10 since a centrifugation phenomenon takes place at the level of the bearings 31–32 and empties them of their grease, with the result that they operate in the dry state and seize up in a very short time.

The operation of the device is as follows: when the member 8 or 8' is set in motion in any known manner by means of the main motor (not shown) of the loom, the needle 5–6 which is guided by the rail 14 carries out a reciprocating movement along a well-determined trajectory. If the movement of the actuating member tends to produce certain imperfections in the trajectory and especially vibrations, such vibrations are absorbed by the flector 18 which is capable of undergoing a displacement in its central portion within the needle, on a conical surface which is centered on the point of attachment of said flector to the needle 5–6 while setting-up considerable resistance to buckling.

The method thus adopted for actuating the needle enables this latter to follow a sufficiently accurate trajectory to be compatible with the very high operating speeds attained in modern looms in which the shed-opening time and the time of exchange of weft thread between the two needles are both of very short duration.

The invention is particularly advantageous in high-speed looms of substantial width since the long distance of travel of the needles entails the need for needle-actuating levers of considerable length, with the result that vibrations appear at the ends of said levers.

The invention is not limited to the embodiments hereinabove described with reference to the accompanying drawings. Depending on the applications which are contemplated, many alternative forms within the capacity of those versed in the art may accordingly be contemplated without thereby departing either from the scope or the spirit of the invention.

What is claimed is:

1. A device for controlling the rectilinear reciprocating movement of weft-inserting needles driven by a needle-actuating lever of a weaving loom, wherein each needle is connected to the needle-driving system by means of a flexible connecting member which is constituted by a flexible member of long and slender shape arranged in coaxial relation to the needle, one end of said flexible member being rigidly fixed by bonding in the vicinity of the end of said needle, the central portion of said long flexible member being free to move laterally with respect to the needle and the opposite end of said long flexible member being coupled to the end of the needle-actuating lever by means of a spindle, and said needle is guided within a rail by means of a block of antifriction material which is attached to the end of said needle.

2. A device according to claim 1, wherein the long flexible member is of reinforced plastic material.

3. A device according to claim 2, wherein the long flexible member is of graphite filled polyamide with a reinforcement of an aramid fiber.

4. A device according to claim 1, wherein the free end of the long flexible member is provided with teeth and pierced by an elongated slot and the teeth are adapted to cooperate with identical teeth of two plates, said plates being rigidly fixed to the spindle which transmits motion to the needle.

5. A device accordng to claim 1, wherein the needle-actuating spindle is adapted to cooperate with continuously-lubricated ball-bearings enclosed within a fluid-tight housing.

6. A device according to claim 1, wherein the long flexible member is of plastic material.

7. A device according to claim 1, wherein the long flexible member is of steel.

8. A device according to claim 1, wherein the antifriction block is of a laminated material consisting of fibers and canvas cemented together by means of a resin.

9. A device according to claim 1, wherein the rail surrounds the needle on three sides, the fourth side being provided with an opening for the passage of the needle-actuating spindle.

* * * * *